US011248425B2

(12) United States Patent
Pettibone

(10) Patent No.: US 11,248,425 B2
(45) Date of Patent: Feb. 15, 2022

(54) LUBRICATOR SKID WITH PIVOTAL RACK

(71) Applicant: Cameron International Corporation, Houston, TX (US)

(72) Inventor: Nathaniel Pettibone, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/939,991

(22) Filed: Jul. 27, 2020

(65) Prior Publication Data

US 2021/0095532 A1 Apr. 1, 2021

Related U.S. Application Data

(60) Provisional application No. 62/907,998, filed on Sep. 30, 2019.

(51) Int. Cl.
*E21B 19/15* (2006.01)
*E21B 19/24* (2006.01)

(52) U.S. Cl.
CPC ..... *E21B 19/155* (2013.01); *E21B 19/24* (2013.01)

(58) Field of Classification Search
CPC ..... E21B 19/155; E21B 19/24; E21B 19/15; E21B 19/14; E21B 19/20; E21B 19/08
USPC ..... 414/22.51–22.71; 211/70.4; 166/378
See application file for complete search history.

(56) References Cited

U.S. PATENT DOCUMENTS 4,439,091 A * 3/1984 Frias ..... E21B 19/15 175/85
6,450,330 B1 * 9/2002 Cannata ..... E21B 19/14 206/303
6,966,106 B1 * 11/2005 Roodenburg ..... E21B 19/14 166/75.11
8,083,009 B2 * 12/2011 Comacchio ..... E21B 19/14 175/52
8,230,991 B1 * 7/2012 Zimmer ..... E21B 19/14 206/303
9,228,398 B2 * 1/2016 Behrens ..... E21B 19/14
2003/0170095 A1 * 9/2003 Slettedal ..... E21B 19/155 414/22.59
2007/0092358 A1 * 4/2007 Innes ..... E21B 19/155 414/22.51
2007/0193749 A1 * 8/2007 Folk ..... E21B 7/02 166/379
2013/0343834 A1 * 12/2013 Flusche ..... E21B 7/023 414/22.55

* cited by examiner

*Primary Examiner* — Lynn E Schwenning
(74) *Attorney, Agent, or Firm* — Kelly McKinney

(57) ABSTRACT

An apparatus for deploying lubricator pipes includes a rack configured to hold a plurality of lubricator pipes in a generally parallel orientation. The rack is pivotable between a stowed configuration and a deployed configuration, and the plurality of lubricator pipes pivot as the rack pivots and remain generally parallel to one another in the rack. The apparatus also includes an actuator coupled to the rack and configured to pivot the rack from the stowed configuration to the deployed configuration.

20 Claims, 7 Drawing Sheets

LUBRICATOR SKID WITH PIVOTAL RACK

BACKGROUND

In the oilfield, lubricator pipe is used in wireline pressure control assemblies to hold wireline tools during rig up and wireline intervention operations. Lubricator pipes ("lubricators") are sections (e.g., one to three meters in length) of round pipe with threaded end connections. Wireline setups may use several sections of lubricator connected end to end in a vertical position. Generally, the lubricators are stored/delivered horizontally on the ground, connected together, and then the full assembly is lifted into the vertical position. The final lift from horizontal to vertical can be a challenge, however, as large, heavy equipment swings in the air as the lubricator pipe is pivoted into position.

SUMMARY

An apparatus for deploying lubricator pipes is disclosed. The apparatus includes a rack configured to hold a plurality of lubricator pipes in a generally parallel orientation. The rack is pivotable between a stowed configuration and a deployed configuration, and the plurality of lubricator pipes pivot as the rack pivots and remain generally parallel to one another in the rack. The apparatus also includes an actuator coupled to the rack and configured to pivot the rack from the stowed configuration to the deployed configuration.

A method for deploying lubricator pipes is disclosed. The method includes delivering a lubricator skid to a wellsite, the lubricator skid comprising a rack in a stowed configuration and holding a plurality of lubricator pipes in a generally parallel configuration, and an actuator coupled to the rack, pivoting the rack relative to the ground from the stowed configuration to a deployed configuration using the actuator, and hoisting the plurality of lubricator pipes out of the rack in the deployed configuration.

An apparatus for deploying lubricator pipes is disclosed. The apparatus includes a frame, and a rack pivotally coupled to the frame and configured to hold a plurality of lubricator pipes in a generally parallel orientation. The rack is pivotable between a horizontal configuration and a vertical configuration, and the plurality of lubricator pipes pivot as the rack pivots and remain generally parallel to one another in the rack. The apparatus also includes an actuator coupled to the rack and the frame and configured to pivot the rack from the horizontal configuration to the vertical configuration.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the embodiments described herein. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the techniques herein is for the purpose of describing particular embodiments only and is not intended to be limiting. As used in the description of the techniques herein and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
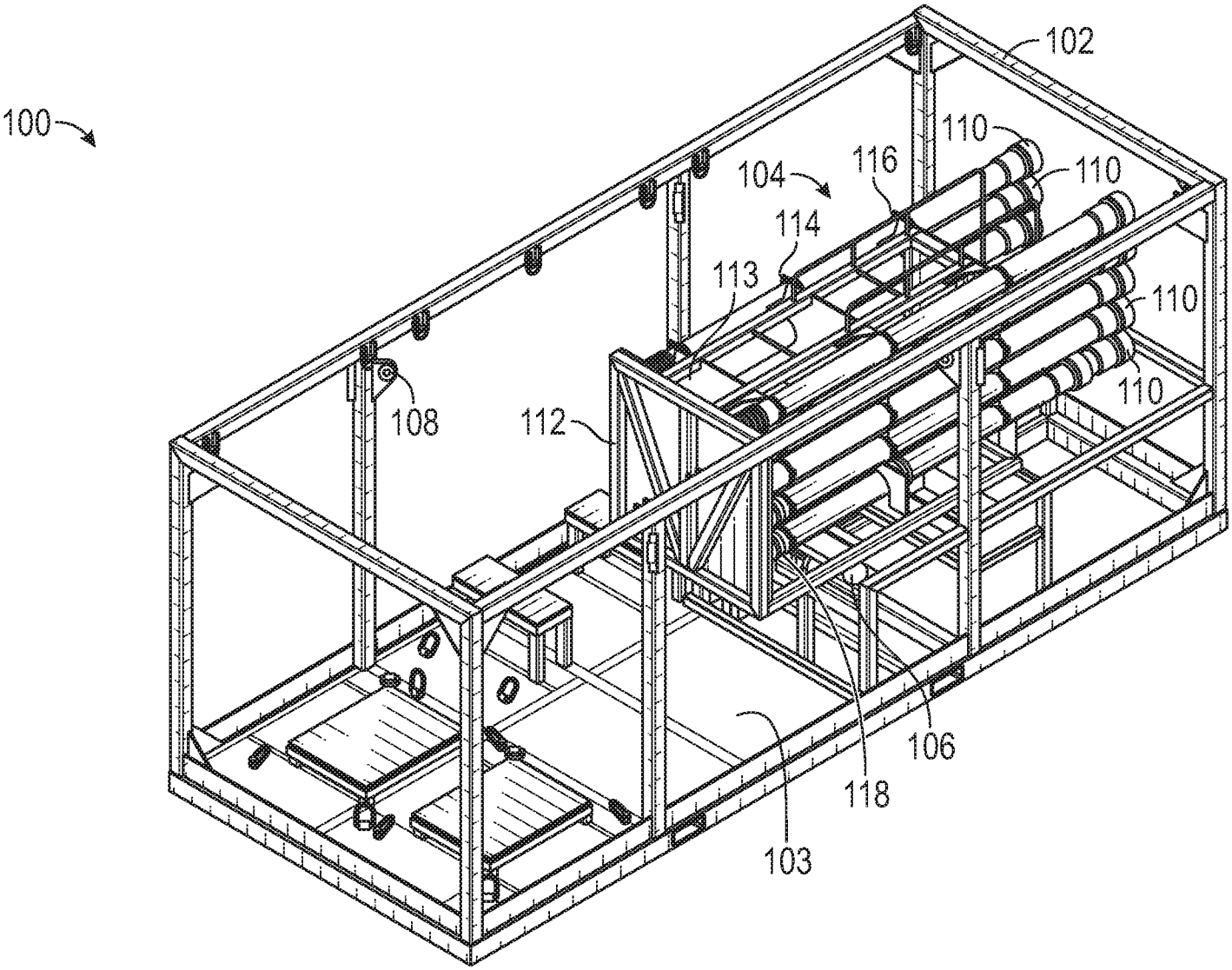
FIG. 1 illustrates a perspective view of a lubricator skid, according to an embodiment.

FIG. 1 illustrates a perspective view of a lubricator skid 100, according to an embodiment. The lubricator skid 100 generally includes a frame 102, a rack 104, and an actuator 106. The frame 102 may be a steel structure configured to support the other components of the skid 100 as a single unit. The frame 102 may include connection members 108, e.g., padeyes, rings, etc., which may be configured to be attached (e.g., hooked) by a crane to lift the lubricator skid 100 as a single unit, e.g., at a wellsite. The frame 102 may include a bottom 103, which may be configured to support a variety of different pieces of equipment, including, for example, a wellhead next to the rack 104.

The rack 104 may be configured to hold a plurality of lubricator pipes 110, e.g., in a generally parallel (e.g., within about 5 degrees of parallel) configuration. The rack 104 may include a base 112 and axially-offset lateral supports 113, 114, 116. A lower end 118 of each of the lubricator pipes 110 may rest on (e.g., abut, engage, etc.) the base 112. Further, the lubricator pipes 110 may be received laterally into slots in the lateral supports 113, 114, 116. As will be described in greater detail below, the lubricator pipes 110 may be clamped into place and secured to the lateral supports 113, 114, 116.

The rack 104 is illustrated in a stowed configuration in FIG. 1. In this configuration, the pipes 110 are held in a generally horizontal (with respect to the ground) orientation (e.g., within about five degrees of horizontal). This orientation may be relatively compact and facilitate transportation of the skid 100. For example, in the stowed configuration, the pipes 110 may be held within the volume delimited by the frame 102.

The rack 104 may be pivotal with respect to the frame 102, and thus with respect to the ground when the skid 100 is positioned on the ground (or on stands, etc.) at a wellsite. For example, the actuator 106 may be configured to pivot the rack 104 to a deployed configuration. In the deployed configuration, the pipes 110 may be oriented generally vertically (e.g., within about 5 degrees of vertical), such that they may be accessed from above, e.g., using a crane, hoisted/lifted vertically, and employed in a well.

Figure 2:
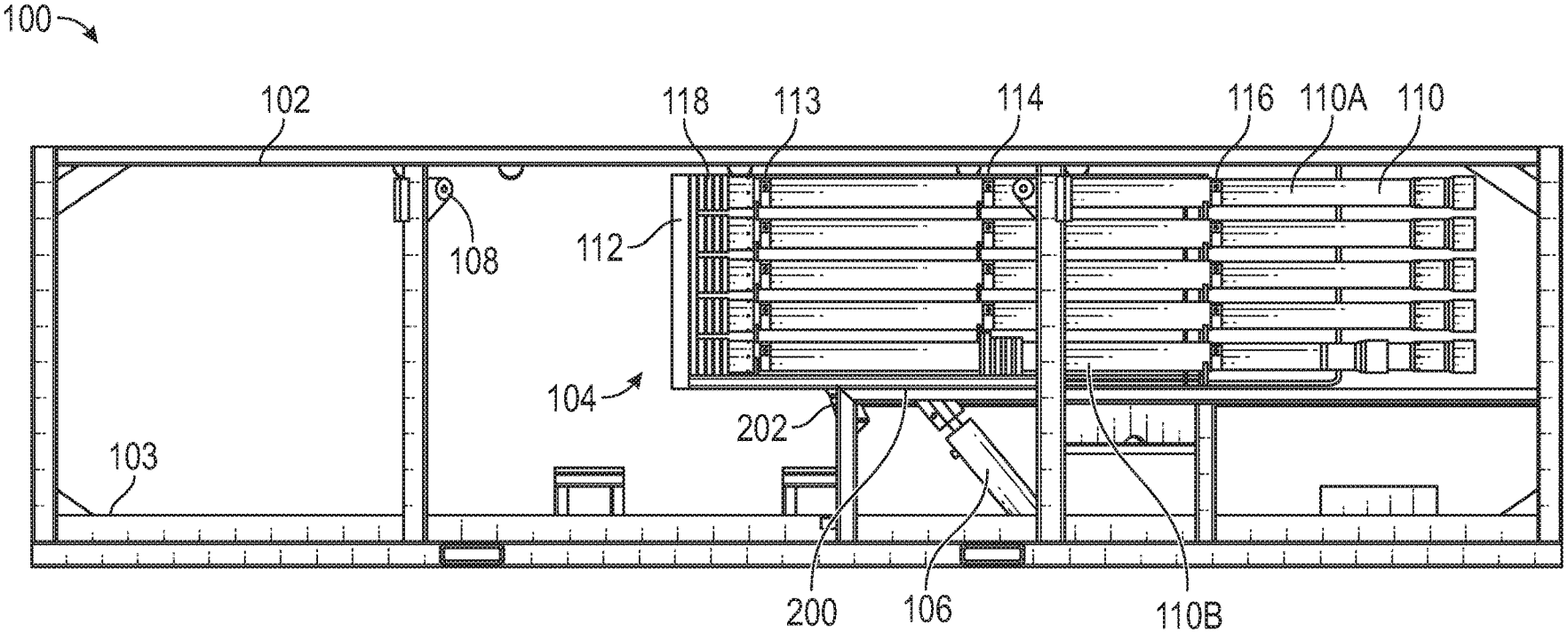
FIG. 2 illustrates a side view of the lubricator skid, according to an embodiment.

FIG. 2 illustrates a side view of the skid 100, according to an embodiment. In this view, the rack 104 is still in the stowed configuration, with the pipes 110 laying in the generally horizontal orientation. As can be seen, the frame 102 may additionally include a stand 200. The stand 200 may include two or more legs (e.g., four legs forming a table). The rack 104 may be coupled to the stand 200, e.g., at a corner 202 thereof. A hinge, pivot-pin, etc., coupling may be used to provide the pivotal connection between the rack 104 and the stand 200.

As can also be seen in FIG. 2, the actuator 106 may be an extensible hydraulic cylinder; however, in some embodiments, two or more cylinders, other types of extensible cylinders, or other types of actuators may be employed. The actuator 106 may include a hydraulic pump, actuation valves, counterbalance (safety) valves, and/or the like. For example, the counterbalance valves may prevent the actuator 106 from releasing the rack 104 to pivot freely by gravity in the event of a loss of fluid pressure.

In the illustrated embodiment, the actuator 106 may extend from below the stand 200 to a pivotal connection with the rack 104. The actuator 106 maybe coupled to the rack 104 such that extending the actuator 106 causes the rack 104 to pivot in a controlled manner so that its base 112 moves through an arc and approaches the ground, and is moved into a parallel arrangement therewith so that it sets down flat against the bottom 103 of the frame 102.

Figure 3:
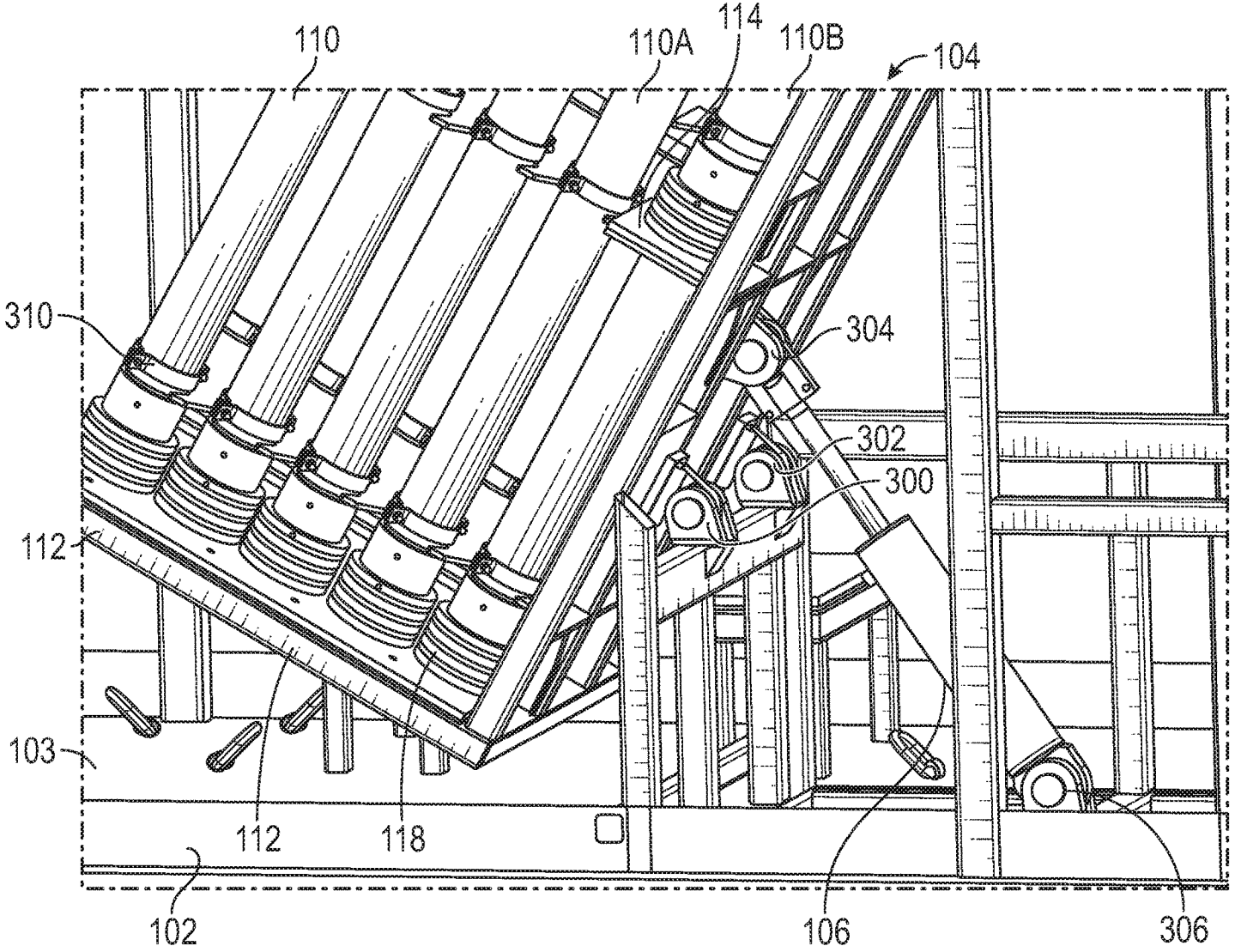
FIG. 3 illustrates an actuator of the lubricator skid extending to pivot a rack of the skid from a stowed configuration to a deployed configuration, according to an embodiment.

FIG. 3 illustrates the actuator 106 extending to pivot the rack 104 from the stowed configuration to the deployed configuration, according to an embodiment. As shown, the rack 104 pivots so that its base 112 approaches the bottom 103 of the frame 102 as the actuator 106 is extended. In particular, FIG. 3 shows the pivotal connections 300, 302 between the stand 200 and the rack 104 and the pivotal connection 304 between the actuator 106 and the rack 104. The connection 304 is higher up on the rack 104 than the connections 300, 302, thereby providing the moment arm for the pivoting movement. Further, a pivotal connection 306 is made between the actuator 106 and the frame 102, e.g., the bottom 103 of the frame 102.

During the pivoting of the rack 104, the lubricator pipes 110 are held generally stationary with respect to the rack 104, i.e., they pivot along with the rack 104. The lubricator pipes 110 thus maintain their generally parallel arrangement. As mentioned above, the lower end of at least some of the pipes 110 rests against the base 112 of the rack 104. As the rack 104 is pivoted to the deployed configuration, the weight of the pipes 110 presses against the base 112, and the base 112 prevents the lubricator pipes 110 from shifting downwards. Further, the lubricator pipes 110 may be secured into position on the rack 104, using clamps 310, straps, or other devices.

Referring to both FIGS. 2 and 3, it will be noted that the lubricator pipes 110 may not all have the same length, at least in this embodiment. For example, first pipes 110A of the pipes 110 extend the full length of the rack 104. However, a second pipe 110B may be shorter than the first pipe(s) 110A, i.e., extend by a smaller length. For example, the second pipe 110B may be about half of the length of the first pipes 110A. In order to secure the shorter, second pipe 110B in position, the lateral support 114 may not have a slot, or the slot may be covered by a plate, or may otherwise be obstructed. As such, the lateral support 114 may serve as the base for the second pipe 110B; however, other such second pipes 110B may extend from the lateral support 114 down to the base 112. It will be appreciated that the lateral support 116 may also serve as a base.

Figure 4:
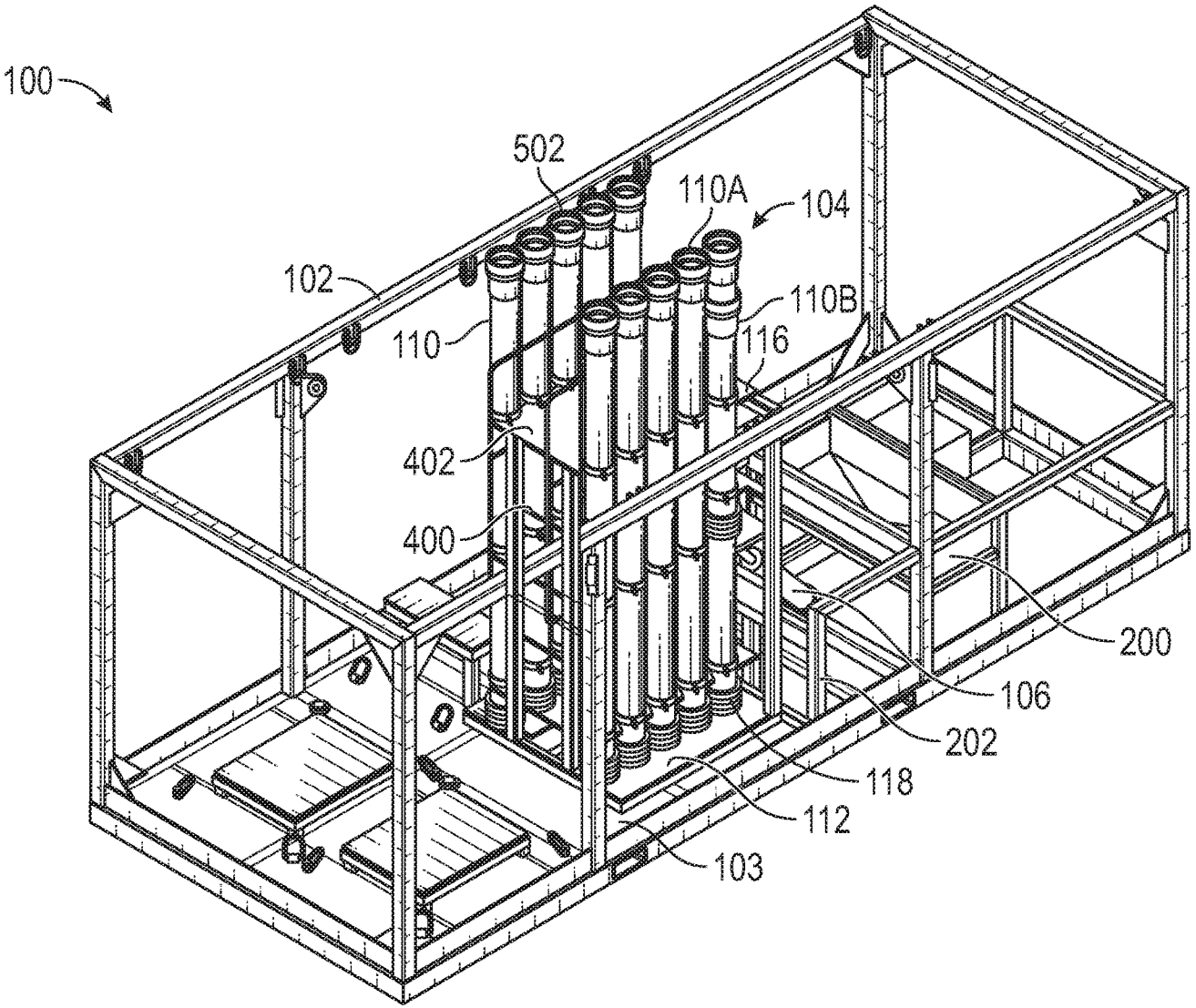
FIG. 4 illustrates a perspective view of the lubricator skid, showing the rack in the deployed configuration, according to an embodiment.
Figure 5:
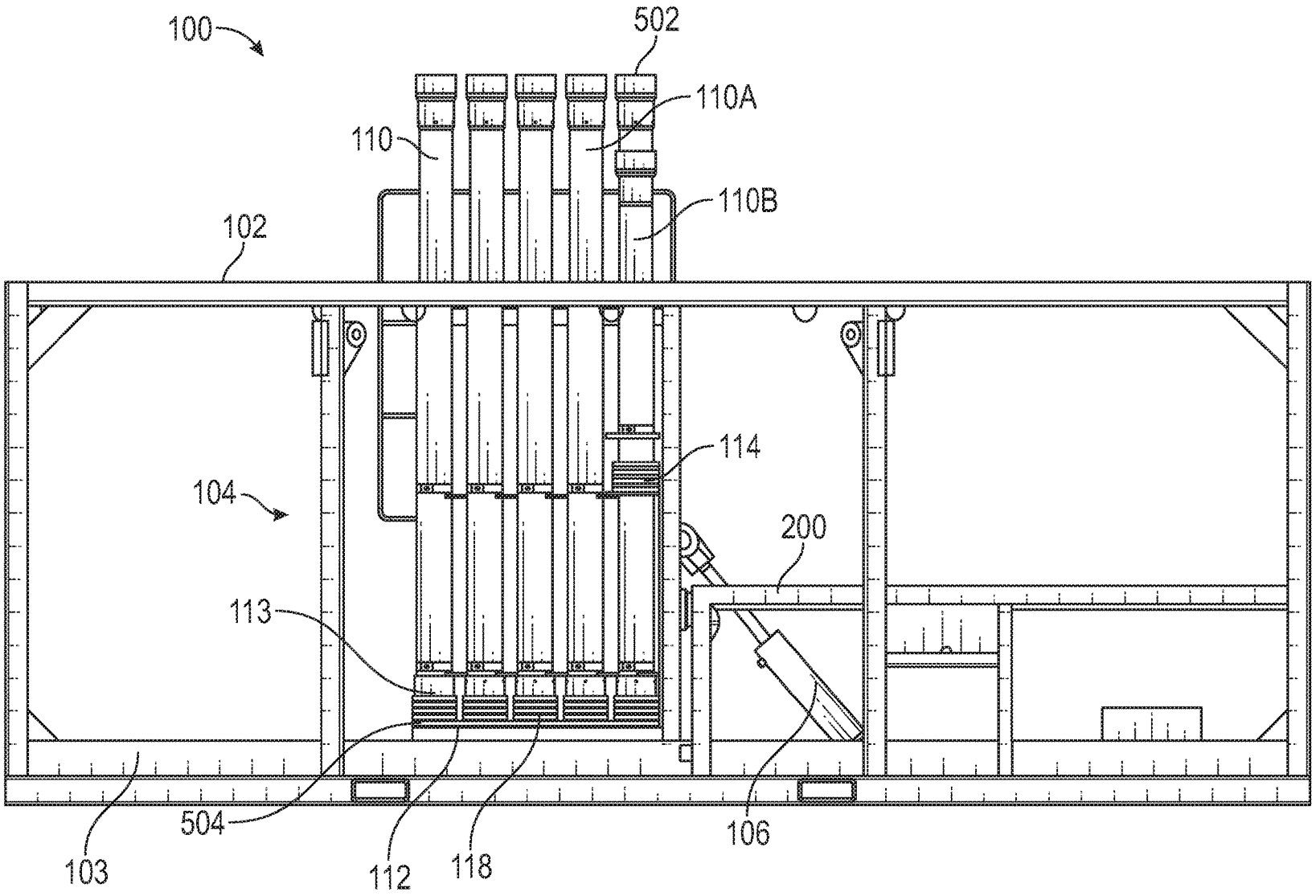
FIG. 5 illustrates a side view of the lubricator skid with the rack likewise in the deployed configuration, according to an embodiment.

FIG. 4 illustrates a perspective view of the lubricator skid 100, showing the rack 104 in the deployed configuration, according to an embodiment. FIG. 5 illustrates a side view of the lubricator skid 100 with the rack 104 likewise in the deployed configuration, according to an embodiment. In the deployed configuration, the rack 104 holds the pipes 110 upright, in a generally vertical orientation. This presents the pipes 110 for access by a crane, elevator, or other tubular hoisting/handling equipment. Further, the rack 104 may include a ladder 400 that leads to an access platform 402. The access platform 402, in some embodiments, may be provided by the lateral support 116. The access platform 402 may be accessible by human operators via the ladder 400. Once at the access platform 402, the operators may secure tubular handling equipment to the tops of the lubricator pipes 110, unclamp the lubricator pipes 110 from the lateral support 116 and/or perform any other task near the top of the lubricator pipes 110.

In some embodiments, the lower ends 118 of the lubricator pipes 110 may be a pin end 118. The lubricator pipes 110 may also include a box end 502, opposite to the pin end 118. The pin end 118 may be at the bottom of the pipes 110, and the box end 502 may be at the top thereof. A coupling 504 may be positioned around the pin end 118. To connect together the pipes 110, the pin end 118 of one pipe 110 is stabbed into the box end 502 of another pipe 110, and the coupling 504 is rotated to mesh threads of the ends 118, 502 together. Embodiments of the present disclosure may facilitate such a lubricator pipe make-up operation, as the pipes 110 may, at one time, be oriented from the stowed horizontal orientation to the vertical orientation. Thus, e.g., with the help of a user on the access platform 402, pipe handling equipment can grip the upper, box end 502 of one of the pipes 110, lift it out of the rack 104, and then stab its pin end 118 into the box end 502 of another one of the pipes 110. The coupling 504 may then be rotated to connect (make-up) the two pipes 110, and the process may repeat until any/all of the pipes 110 are made-up into a string.

Figure 6:
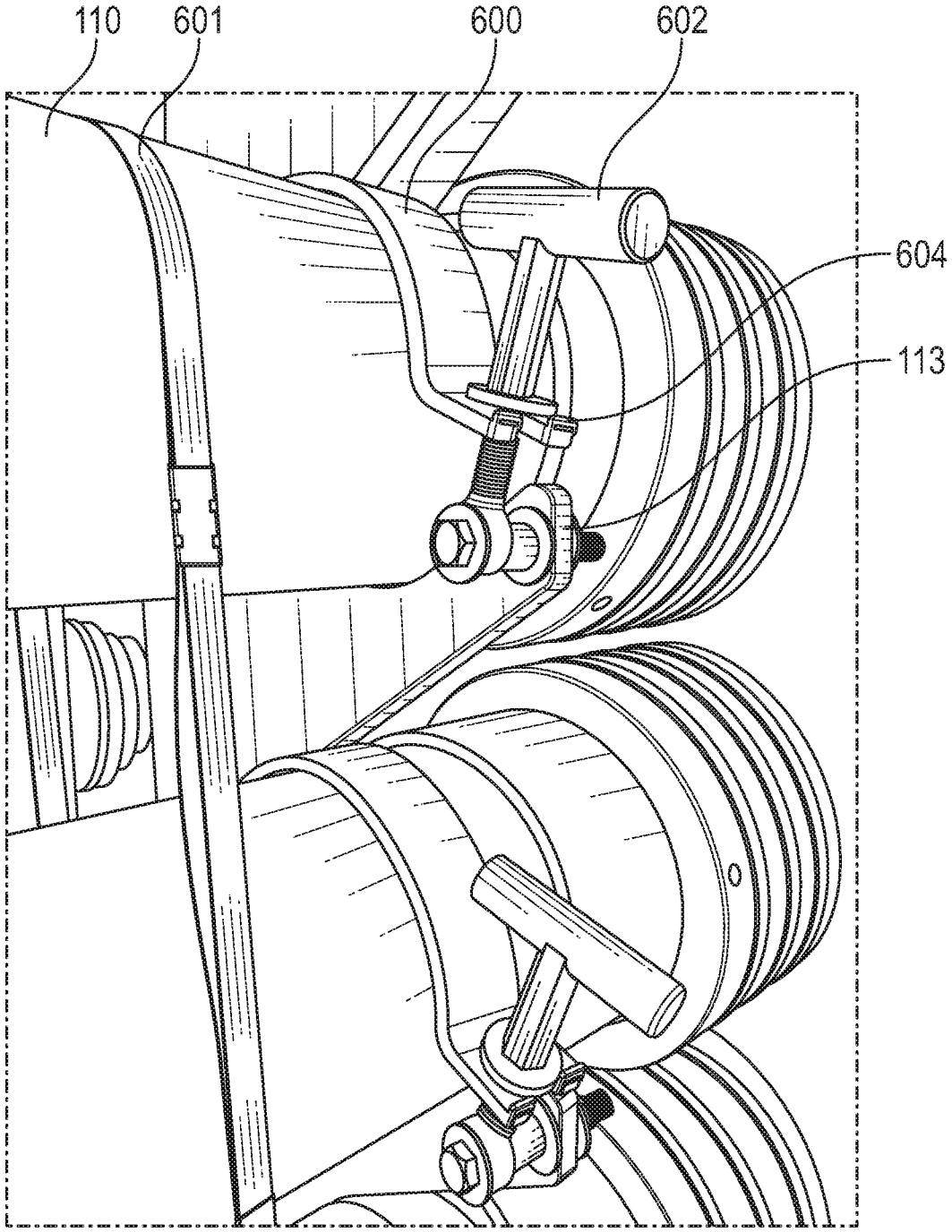
FIG. 6 illustrates a perspective view of a portion of a lateral support of the rack and two lubricator pipes secured therein, according to an embodiment.

FIG. 6 illustrates a perspective view of a portion of the lateral support 113 and two pipes 110 secured therein, according to an embodiment. As mentioned above, clamps 310 may be employed to hold the pipes 110 in the rack 104. In the illustrated embodiment, the clamp 310 may include an arcuate member 600 and a handle 602. The arcuate member 600 may include a slot 604 for receiving the handle 602 on one side and may be pivotally coupled to the lateral support 113 on the other side. Between the ends, the arcuate member 600 may be shaped to fit around the pipe 110. The handle 602 may be pivotally coupled to the lateral support 113. The handle 602 may be received into the slot 604 and rotated so as to tighten the arcuate member 600 around the pipe 110. As also shown in FIG. 6, straps 601 or other secondary structures for securing the pipes 110 to the rack 104 may also be employed.

Figure 7:
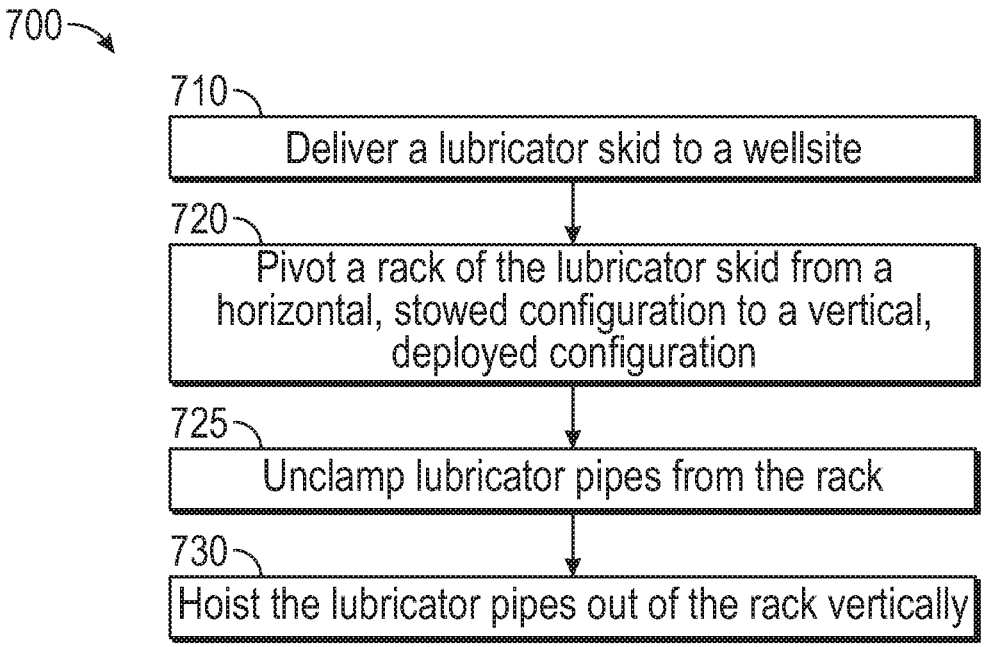
FIG. 7 illustrates a flowchart of a method for deploying lubricator pipes, according to an embodiment.

FIG. 7 illustrates a flowchart of a method 700 for deploying lubricator pipes, according to an embodiment. The method 700 may be executed using one or more embodiments of the lubricator skid 100 discussed above, but may, in some embodiments, be executed using other structures. The method 700 may include delivering a lubricator skid 100 to a wellsite, as at 710.

Upon delivery, the lubricator skid may have a rack 104 in a stowed position and holding a plurality of lubricator pipes 110 in a generally parallel configuration. The lubricator skid 100 may also include an actuator 106 coupled to the rack 104. The lubricator skid 100 may further include a frame 102 into which the various components thereof are configured to fit. In an embodiment, delivering at 710 may include hoisting the lubricator skid 100 using a crane attached to connection members 108 of the frame 102 of the lubricator skid 100.

The method 700 may then proceed to pivoting the rack 104 relative to the ground or the frame 102 from the stowed configuration to a deployed configuration using the actuator 106, as at 720. For example, pivoting the rack may include extending a hydraulic cylinder of the actuator 106. In some embodiments, the rack 104 in the stowed configuration holds the plurality of lubricator pipes 110 in a horizontal orientation, and the rack 104 in the deployed configuration holds the plurality of lubricator pipes 110 in a vertical orientation.

The method 700 may further include unclamping the lubricator pipes 110 from the rack 104, as at 725. This may occur all at once, or when each individual pipe 110 is ready to be removed from the rack 104.

Before, during, or after unclamping at 725, the method 700 may include hoisting the plurality of lubricator pipes 110 (e.g., sequentially) out of the rack 104 in the deployed configuration, as at 730. In an embodiment, hoisting may include gripping an upper end of one of the lubricator pipes that extends upward, out of the rack 104. At such time, a lower end of the lubricator pipe may be supported by a base 112 of the rack 104.

More specifically, in an embodiment, hoisting the plurality of lubricator pipes 110 out of the rack 104 in the deployed configuration may include lifting a first pipe of the plurality of lubricator pipes, connecting a lower end of the first pipe to an upper end of a second pipe of the plurality of lubricator pipes, and lifting a combination of the first and second pipes upward. As such, the lubricator pipes 110 are connected together vertically, which may simplify the lubricator pipe deployment process.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. An apparatus for deploying lubricator pipes, comprising:

a rack configured to hold a plurality of lubricator pipes in a generally parallel orientation and comprising an access platform, wherein the rack is pivotable between a stowed configuration and a deployed configuration, and wherein the plurality of lubricator pipes pivot as the rack pivots and remain generally parallel to one another in the rack as the rack pivots; and an actuator coupled to the rack and configured to pivot the rack from the stowed configuration to the deployed configuration.

2. The apparatus of claim 1, further comprising a frame, the actuator being coupled to the frame and extensible therefrom, and the rack being pivotally coupled to the frame so as to pivot with respect thereto by extending or retracting the actuator.

3. The apparatus of claim 2, wherein the frame comprises connection members that are configured to couple to a crane, such that the frame, the actuator, and the rack are liftable together by operation of the crane.

4. The apparatus of claim 1, wherein the rack holds the plurality of lubricator pipes in a generally horizontal orientation in the stowed configuration, and wherein the rack holds the plurality of lubricator pipes in a generally vertical orientation in the deployed configuration.

5. The apparatus of claim 1, wherein the access platform is at a top of the rack in the deployed configuration and is at a side of the rack in the stowed configuration.

6. The apparatus of claim 1, further comprising clamps that are configured to secure the plurality of lubricator pipes in the rack while the rack pivots.

7. The apparatus of claim 1, wherein the rack is configured to engage pipe couplings at lower ends of the plurality of lubricator pipes, and wherein the rack is configured such that upper ends of the plurality of lubricator pipes extend upward from the rack in the deployed configuration.

8. The apparatus of claim 1, wherein the actuator comprises a hydraulic cylinder that is configured to extend to pivot the rack from the stowed configuration to the deployed configuration.

9. The apparatus of claim 1, wherein the rack comprises a lateral support in which a first pipe of the plurality of lubricator pipes is received laterally, and wherein a second pipe of the plurality of lubricator pipes has a lower end that is in contact with the lateral support, the first pipe being longer than the second pipe.

10. A method for deploying lubricator pipes, comprising:

delivering a lubricator skid to a wellsite, the lubricator skid comprising a rack in a stowed configuration and holding a plurality of lubricator pipes in a generally parallel configuration, and an actuator coupled to the rack;

pivoting the rack relative to the ground from the stowed configuration to a deployed configuration using the actuator, wherein the rack in the deployed configuration holds the plurality of lubricator pipes in a vertical orientation; and hoisting the plurality of lubricator pipes out of the rack in the deployed configuration by gripping a respective upper end portion of each of the plurality of lubricator pipes and lifting each of the plurality of lubricator pipes vertically out of the rack.

11. The method of claim 10, wherein delivering the lubricator skid comprises hoisting the lubricator skid using a crane attached to connection members of a frame of the lubricator skid.

12. The method of claim 11, wherein pivoting the rack comprises pivoting the rack relative to the frame using the actuator.

13. The method of claim 10, wherein the respective upper end portion is contained within a frame of the lubricator skid while the rack is in the stowed configuration and extends vertically upward out of the frame while the rack is in the deployed configuration.

14. The method of claim 10, further comprising unclamping the plurality of lubricator pipes from the rack.

15. The method of claim 10, wherein hoisting the plurality of lubricator pipes out of the rack in the deployed configuration comprises:

lifting a first pipe of the plurality of lubricator pipes;

connecting a lower end of the first pipe to an upper end of a second pipe of the plurality of lubricator pipes; and lifting a combination of the first and second pipes upward.

16. The method of claim 10, wherein the rack in the stowed configuration holds the plurality of lubricator pipes in a horizontal orientation.

17. An apparatus for deploying lubricator pipes, comprising:

a frame;

a rack pivotally coupled to the frame and configured to hold a plurality of lubricator pipes in a generally parallel orientation, wherein the rack is pivotable relative to the frame from a horizontal configuration to a vertical configuration to set a base of the rack flat against a surface of the frame, and wherein the plurality of lubricator pipes pivot as the rack pivots and remain generally parallel to one another in the rack as the rack pivots; and an actuator coupled to the rack and the frame and configured to pivot the rack relative to the frame from the horizontal configuration to the vertical configuration.

18. The apparatus of claim 17, wherein the frame, the rack, and the actuator are configured to be lifted as a single unit.

19. The apparatus of claim 17, wherein each of the plurality of lubricator pipes extend between the base of the rack and an opening formed in the frame while the rack is in the vertical configuration, and each of the plurality of pipes is accessible to be removed from the rack vertically through the opening formed in the frame when the rack is in the vertical configuration.

20. The apparatus of claim 17, wherein the plurality of lubricator pipes engage the base when the rack is in the horizontal configuration, the vertical configuration, and as the rack is pivoted between the horizontal configuration and the vertical configuration, such that the base is configured to prevent the plurality of lubricator pipes from shifting in the rack.

* * * * *